US006294237B1

(12) United States Patent
Popat

(10) Patent No.: US 6,294,237 B1
(45) **Date of Patent: *Sep. 25, 2001**

(54) FREE FORM LAMINATED CARDSTOCK ASSEMBLY

(75) Inventor: Ghanshyam H. Popat, Alta Loma, CA (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/972,062

(22) Filed: Nov. 17, 1997

(51) Int. Cl.[7] ..... G09F 3/10

(52) U.S. Cl. ..... 428/40.1; 40/628; 40/629; 40/630; 283/81; 283/101; 283/106; 283/109; 428/41.8; 428/41.9; 428/42.2; 428/42.3; 428/43; 428/192; 428/194; 428/212; 473/588; 473/590

(58) Field of Search ..... 428/40.1, 41.8, 428/41.9, 42.2, 42.3, 212, 192, 194; 283/81, 101, 106, 109; 40/628, 629, 630, 626; 473/590, 588

(56) References Cited

U.S. PATENT DOCUMENTS

| | | | | |
|---|---|---|---|---|
| 3,197,899 | | 8/1965 | Twentier | 40/21 |
| 4,263,347 | * | 4/1981 | Banta | 428/194 |
| 4,314,415 | | 2/1982 | DeWoskin | 40/21 |
| 4,771,891 | | 9/1988 | Sorensen et al. | 206/459 |
| 4,781,957 | * | 11/1988 | Brown | 428/43 |
| 5,407,718 | | 4/1995 | Popat et al. | 428/42.1 |
| 5,518,787 | | 5/1996 | Konkol | 428/43 |
| 5,662,976 | | 9/1997 | Popat et al. | 428/40.1 |
| 6,016,618 | * | 1/2000 | Attia | 40/633 |

OTHER PUBLICATIONS

Copy of Flyer Published by Rich Harrison in his Annual Catalog Entitled "The Boomerang Man" Showing a Variety of Boomerang Shapes for Sale (1997).

* cited by examiner

*Primary Examiner*—Nasser Ahmad
(74) *Attorney, Agent, or Firm*—Oppenheimer Wolff & Donnelly LLP

(57) ABSTRACT

An assembly for creating free form laminated objects, such as a throwing toys or napkin ring that can be printed or decorated by the use of printer or copier without jamming. The assembly includes a sheet of cardstock or thin printable sheet material, a sheet of transparent laminated plastic and intermediate adhesive layer that adheres the cardstock sheet and laminated sheet together. The cardstock sheet has a die cut outline configured to the desired shape of an object. The laminated sheet has a die cut outline substantially extending outside of the outline on the cardstock sheet, to allow laminated sheet to fold over and entirely cover the cardstock area within the cardstock die cut outline. The assembly has a substantially constant thickness and substantially flat upper and lower surfaces so that the assembly can pass through a printer or copier without jamming. Once a printer or copier has printed on the cardstock area, the cardstock area may be push through the assembly carrying the die cut plastic area, and the plastic sheet material may be folded over and bonded to the cardstock area. The final printed laminated configuration may either be flat or further configured to a three-dimensional format. For the three-dimensional configuration, the cardstock area may have a plurality of notches extending transversely across, where it may be curved along the cardstock area, and held in this configuration by the overlying transparent plastic laminate.

28 Claims, 6 Drawing Sheets

FIG. 6
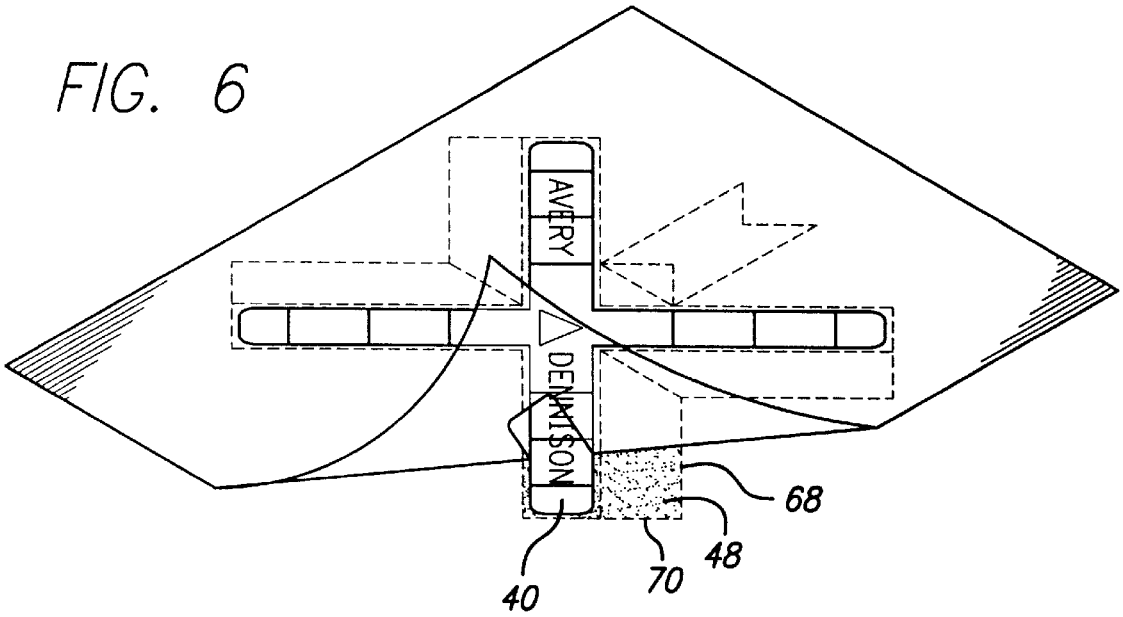
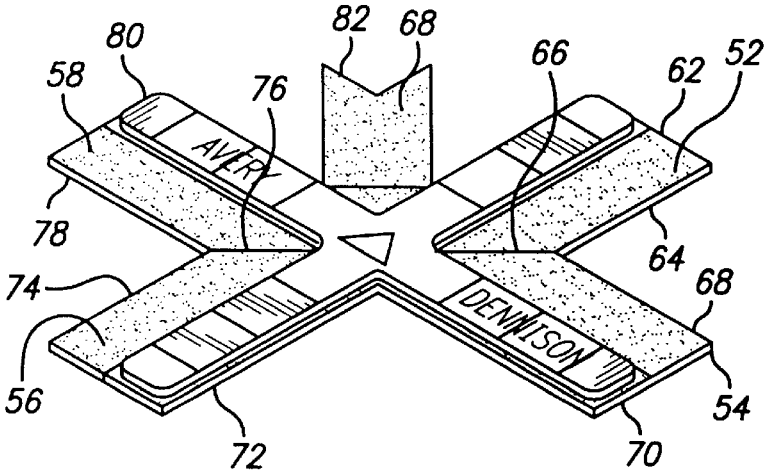
FIG. 7
FIG. 8
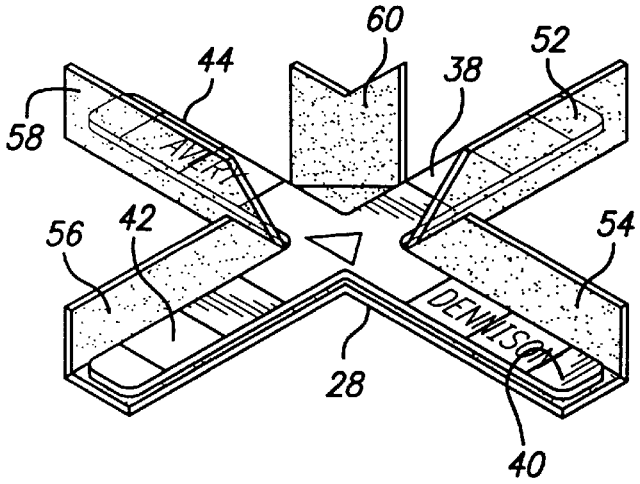

FREE FORM LAMINATED CARDSTOCK ASSEMBLY

FIELD OF THE INVENTION

This invention relates generally to the field of laminated cardstock that can be printed or decorated by use of a printer or copier.

BACKGROUND

Reference is made to U.S. Pat. No. 5,662,976 entitled "Laminated Card Assembly" and granted on Sep. 2, 1997. This patent teaches a method for creating laminated cards for printing by a laser printer from an assembly. There are three basic material components to this invention, a cardstock sheet, a transparent laminated plastic film, and intermediate pressure sensitive adhesive that adheres the cardstock sheet and plastic film together. A user feeds the assembly into a printer. The printer prints onto the surface of the cardstock that may be die cut into the shape of a membership card, for example. The user removes the card from the assembly and concurrently peels a rectangular area of the transparent plastic from the assembly. The user then folds the transparent plastic to cover the printed surface of the card. This transparent plastic layer serves the function of displaying the information and protecting the information on the card.

Laminated cards, such as the one referenced above, tend to have simple shapes. They typically come in the size and shape of a business or membership card that is rectangular so that it can be easily laminated. Even adhesive index tabs and hinging file folder tabs have relatively simple symmetrical configurations that fold over about the center line, which allows easy lamination to take place. Hence, laminated cards have generally been limited to simple flat configurations. Furthermore, laminated cards typically have no function, other than to display the information on the card in a protective manner.

Consequently, while the a "Laminated Card Assembly" disclosed in U.S. Pat. No. 5,662,976 are useful for providing a construction for displaying the information on the card in a protective manner, it has shortcomings in that its function is limited to expressing the information on the card in a simple two-dimensional format. Accordingly, a need still exists for a laminated construction that can do more than simply display information in a simple two-dimensional rectangular configuration.

SUMMARY OF THE INVENTION

The present invention is directed generally to a laminated cardstock assembly that can do more than merely display the information on the card. It is object of this invention to provide an assembly for creating assorted goods, such as throwing toys and napkin rings that can be personally decorated using a printer or copier. While these products are not limited to simple configurations, they are relatively quick and easy to assemble.

Viewed from a broad perspective, the invention may be an assembly including a cardstock sheet, a transparent plastic lamination sheet, and a layer of pressure sensitive adhesive adhering the cardstock sheet and transparent plastic sheet together. The assembly may be flexible enough to reliably pass through a printer or copier. Preferably, the assembly may have constant thickness to allow the assembly to pass through a printer without jamming. The cardstock sheet may have a die cut outline defining the shape of the good to be created. The transparent plastic laminated sheet may also be die cut in a peripheral outline substantially outside of the die cut outline on the cardstock, and may be irregular or non-symmetrical with respect to the shape of the cardstock area defining the good to be created. Printed laminated goods may be created by feeding the assembly into the printer for initial printing; then the cardstock area may be pushed through the assembly carrying the die cut plastic areas; and subsequently the plastic sheet material may be folded over and bonded to the die cut cardstock configuration.

Various additional features may be associated with the present invention. The cardstock sheet may have certain areas that have a release coating for convenience in peeling back a portion of the transparent plastic laminating sheet. Preferably, however, no release layer is provided in the area overlying the die cut cardstock so that the transparent plastic is firmly bonded thereto. Alternatively, the backing sheet may be coated across its entire width and length with a release coating. The cardstock sheet may lie coextensively with the transparent plastic lamination sheet. Preferably the assembly may be no more than about 12 to 15 mils thick for reliable feeding through printers or copiers. The pressure sensitive adhesive may also be a permanent pressure sensitive adhesive. The plastic film may also have perforations or a line of weakness that runs slightly outside and adjacent to the die cut outline on the cardstock, for ease in forming the final assembly.

One version of the present invention may comprise a multilayer sheet assembly for creating printed laminated throwing toys or the like. The cardstock sheet will have die cut outline defining the shape of the throwing toys or similar structures to be formed. The transparent plastic lamination sheet will also have a die cut peripheral outline that is substantially outside of the die cut outline on the cardstock.

Another embodiment of the present invention may be an assembly for creating printed laminated three-dimensional throwing toy with plurality of wings. The cardstock sheet may have a die cut outline defining the shape of the throwing toy with these wings. Preferably wings may be aligned symmetrically around a center. Additionally, the cardstock sheet area as defined by die cut outline may also have a plurality of notches or lines of weakness extending transversely across its structure. The notches or lines of weakness allow the assembly to be readily formed into a curved shape. The transparent plastic lamination sheet may also have a die cut in a peripheral outline substantially outside of the die cut outline on the cardstock, in order to encompass the die cut outline on the cardstock sheet. The flexible plastic sheet may have additional die cuts from the periphery of the plastic sheet outline into the edge of the cardstock outline. Once printing is completed the cardstock area may be pushed through the assembly carrying the die cut plastic area, and the plastic sheet material may be folded over and bonded to the cardstock area that has the plurality of wings aligned symmetrically around a center. The throwing toy may be either flat in its final configuration or it may have three-dimensional transversely curved wings. For the three-dimensional configuration, the cardstock area may be shaped where it is notched, and then held in this shaped configuration by the overlying or overlapping transparent plastic laminate.

In accordance with another exemplary embodiment of the invention, the assembly may be used for making a napkin ring or cup holder. The cardstock sheet may have a die cut outline in a shape of long rectangle. The transparent plastic lamination sheet may also have a die cut in a peripheral outline that may be slightly greater than twice the size of die cut outline on the cardstock. Thereafter, a napkin ring may be created by feeding the assembly into the printer for initial printing, and then the cardstock area may be pushed through the assembly carrying the die cut plastic area. Once the napkin ring assembly is removed, the opposite ends of the long rectangle may be coupled together, forming a cylindrical shape. Afterwards, the plastic sheet material may be folded over and bonded to the cardstock in a cylindrical shape. A printed laminated three-dimensional napkin ring is thus created.

In accordance with another aspect of the invention, the plastic sheet material is die cut in a complex pattern which will not merely cover the other side of the cardstock, but may hold it in a three-dimensional configuration, preferably using permanent pressure sensitive adhesive. Hence, the configurations are not limited to creating a printed laminated cardstock that is in simple two-dimensional format. Yet, it is quick and easy to assemble.

Other objects, features and advantages will become apparent from a consideration of the following detailed description and from the accompanying drawings.

BRIEF DESCRIPTION OF THE DRAWINGS

FIG. 6 shows a throwing toy being peeled off from the assembly shown in FIG. 1;

FIG. 7 is a perspective view showing the throwing toy after it was peeled off from assembly shown in FIG. 6;

FIG. 8 is a perspective view of the flaps being fold over along the perforations;

DETAILED DESCRIPTION OF PREFERRED EMBODIMENTS

The following is a detailed description of the best presently known mode of carrying out the invention. This description is not to be taken in a limiting sense, but is made merely for the purpose of illustrating the general principles of the invention. The scope of the invention is defined by the appended claims.

Figure 3:
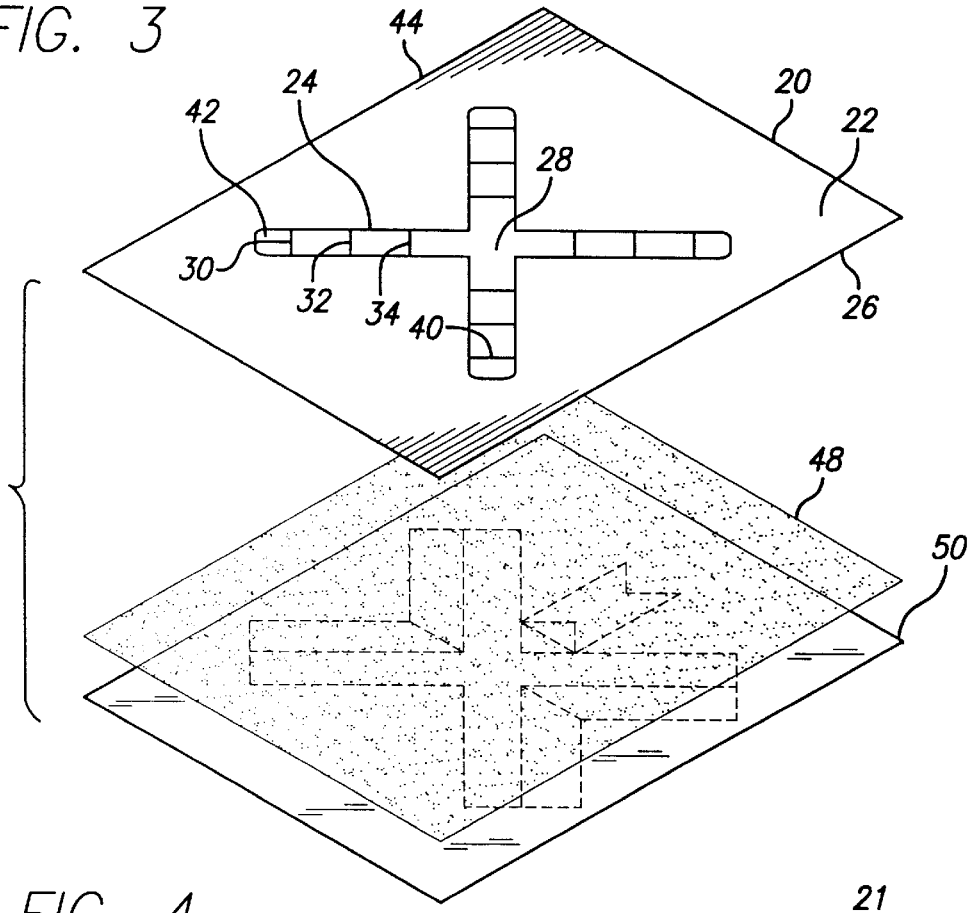
FIG. 3 is a expanded perspective view of the assembly shown in FIG. 1.
Figure 4:
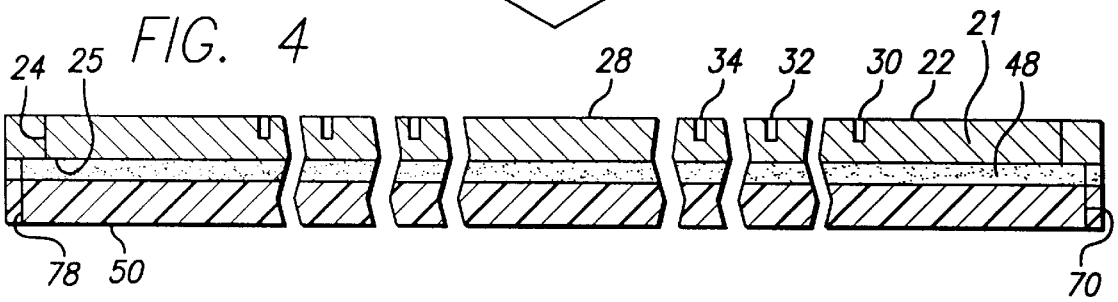
FIG. 4 is a cross-sectional view of the assembly taken along line 4—4 of FIG. 1.

As shown by way of example in FIGS. 1–10, a laminated cardstock assembly 10 in accordance with one embodiment of the present invention includes a cardstock sheet 20 on the top and a laminated transparent plastic sheet 50 on the bottom. As illustrated for example in FIG. 3, the cardstock sheet 20 has a top side 22 for receiving printing, and an opposite surface or side 25 having a release coating. The plastic sheet 50 is coated with intermediate layer of pressure sensitive adhesive 48. As best shown in FIG. 4, the intermediate pressure sensitive adhesive 48 adhered to the opposite surface 25 with the release coating.

As shown by way of example in FIG. 3, the top layer of cardstock 20 is preferably a heavy paper or light cardboard that is die cut into an outline configuration 24. This configuration has a plurality of wings 38, 40, 42, and 44, aligned symmetrically around a center 28. Additionally, as shown by way of example in FIG. 4, the top surface 22 has a plurality of notches 30, 32, and 34 that extend transversely across the surface, which enable the wings to take a curved (non-planner) shape, such as that illustrated in FIG. 10.

Figure 1:
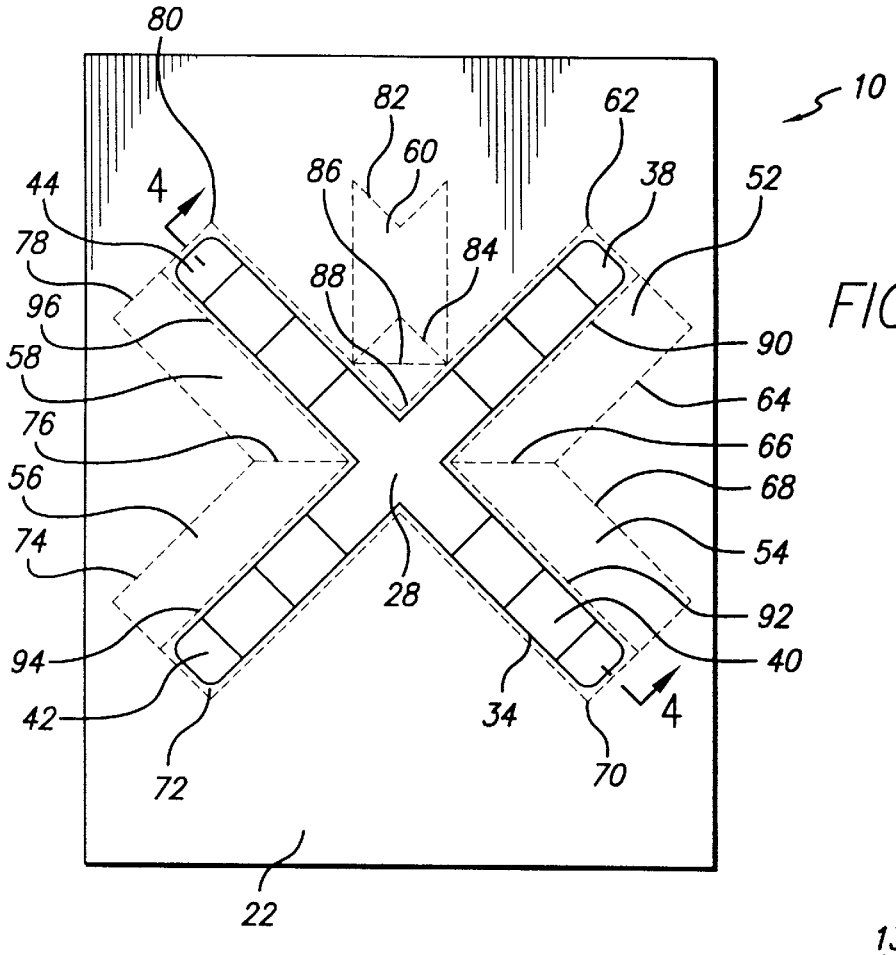
FIG. 1 is a top view of an assembly illustrating one aspect of the present invention.
Figure 2:
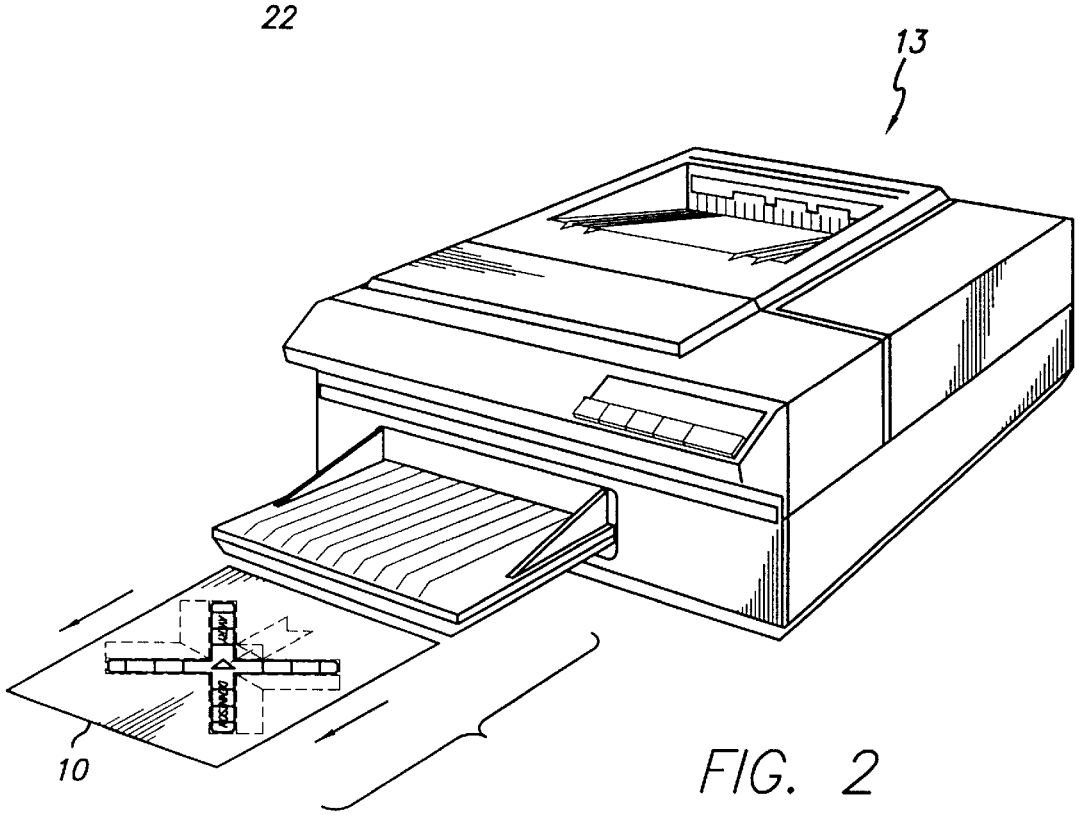
FIG. 2 shows a laser printer, with the assembly shown in FIG. 1 exiting from the laser printer.

As illustrated for example in FIGS. 1 and 3, the bottom transparent laminated plastic sheet 50 has multiple die cuts. The die cuts are configured to allow plastic sheet 50 to entirely cover the plurality of wings 38, 40, 42, and 44 and the center 28 on the cardstock. Each wing is paired with a plastic lamination flap: wing 38 with flap 52, wing 40 with flap 54, wing 42 with flap 56, and wing 44 with flap 58. The plastic lamination flap 52 has an outline defined by the die cuts 64, 66, and 62. The die cut 64 has peripheral outline that extends substantially outside of the die cut outline defined by the wing 38, while the die cut 62 has peripheral outline that extends slightly outside of the die cut outline defined by the wing 38, and the die cut 66 runs from the corner edge of the wings 38 and 40, to the peripheral outline die cut 64. Likewise, flap 54 has an outline defined by die cuts 68, 66, and 70; flap 56 has an outline defined by die cuts 74, 72, and 76; and flap 58 has an outline defined by die cuts 78, 80, and 76. Additionally, flaps 52, 54, 56, and 58 may have perforations along centerlines 90, 92, 94, and 96, respectively. The perforation lines make it easier for the plastic laminated flaps to fold over and bond to the wings.

The center 28 in this exemplary embodiment is paired with the plastic lamination strip 60, which is configured to cover the cardstock area not cover by the flaps 52, 54, 56, and 58. The strip 60 has an outline defined by the die cut 82. And also has perforations 84 and 88. The strip 60 may also have a perforation 86, to make it easier for the strip 60 to fold over and bond to the center 28 of the cardstock.

The die cuts 62, 64, 66, 68, 70, 72, 74, 76, 78, 80, and 82 preferably extend completely through the plastic film 50 and the pressure sensitive adhesive 48, but do not penetrate into surface 25 of the cardstock sheet 20. Likewise, die cut 24 preferably extend completely through the cardstock 20, but do not penetrate into the pressure sensitive adhesive 48. Furthermore, assembly 10 preferably has a substantially constant thickness and substantially flat top layer and bottom layer so that the assembly 10 can pass through the complex paper path of a printer or photocopier without jamming.

The present invention may be fed into a variety of printers or photocopiers. Such printers include those typically used in the home or office, such as the laser printer 13 shown in FIG. 2, color laser jet, laser jet, ink jet, bubble jet, or thermal transfer. The types of printers and photocopiers that may be used, however, is not limited to those list stated above. The printer may be used to print various decorations, designs, advertisements, or useful information on the printing surface 22. After the assembly exits the printer or photocopier, the throwing toy assembly is peeled off along the die cuts, as illustrated for example in FIG. 6.

To peel the throwing toy from the assembly, the user pushes the toy through the area defined by die cut 24. Concurrently, flaps 52, 54, 56, and 58, along with strip 60, are peeled off of release coating on the cardstock surface 25. FIG. 7 shows the throwing toy assembly after it has been removed from the assembly 10. Preferably, the area within the die cut outline 24 is not release coated on the cardstock surface 25, so that the plastic sheet is firmly bonded to cardstock outline area 24.

Figure 9:
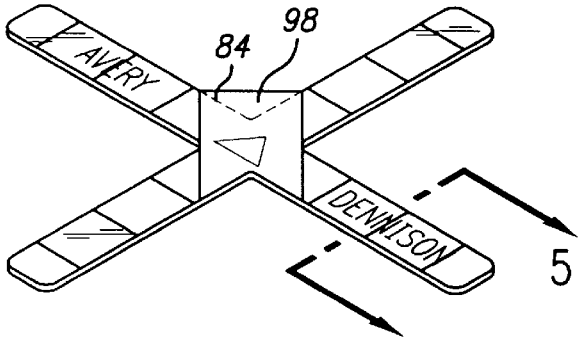
FIG. 9 is a perspective view of the throwing toy after it has been laminated.

As illustrated for example in FIG. 8, the user then folds flaps 52, 54, 56, and 58 over respective wings 38, 40, 42, and 44, and then fold the strip 60 over the center 28. The strip and flaps may be folded in any order. For instance, the strip may be folded before the flaps. Furthermore, if the laminated plastic sheet includes a line of perforation such as 90, 92, 94, 96, and 86, user may fold the lamination plastic flaps and strip over along the line of perforations. Afterwards, user may then press the entire throwing toy assembly to seal the lamination plastic flaps and strip to form a throwing toy assembly. Turning to FIG. 9, the strip 60 is folded over and bonded to the area not covered by flaps 52, 54, 56, and 58. Afterwards, the corner piece 98 remains, and it may be removed by applying sufficient pressure to detach it along perforation lines 84 and 88.

Figure 10:
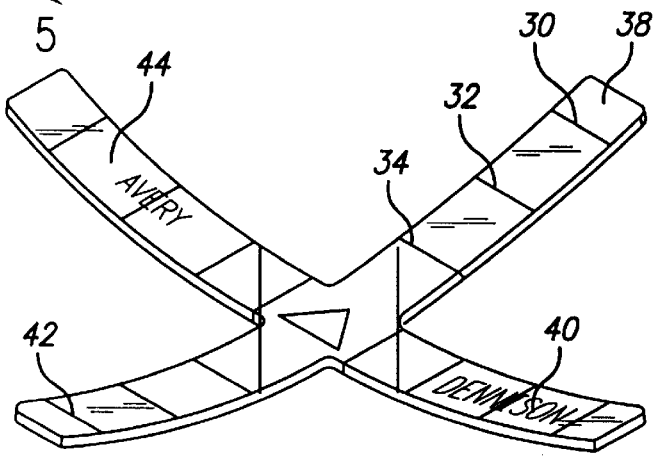
FIG. 10 is a perspective view showing an exemplary three dimensional printed laminated throwing toy inn accordance with present invention.

At this point, the throwing toy may either remain flat in its final configuration or it may have three-dimensional shape illustrated, for example, in FIG. 10. To obtain the three-dimensional configuration, wings 38, 40, 42, and 44 may be curved along notches 30, 32, and 34.

Figure 5:
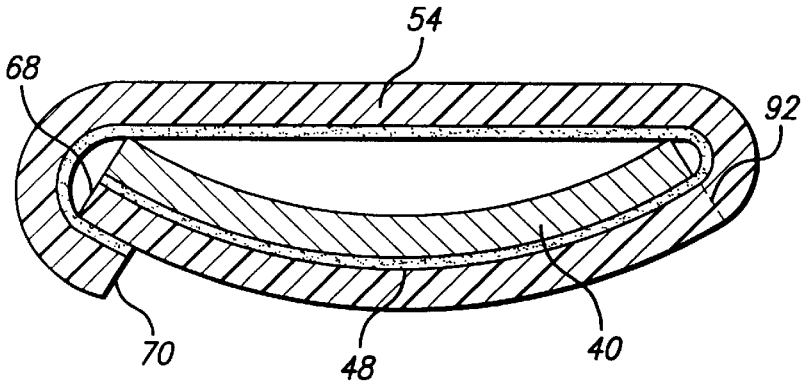
FIG. 5 is a cross-sectional view of the assembly taken along line 5—5 of FIG. 9.

The wings may also be transversely curved as illustrated for example in FIG. 5. To obtain this configuration, the cardstock wings are first curved in the transverse direction. Next, the flap 54 is folded over along perforations 92, and the wing 40 is held in this configuration by the overlying transparent plastic laminate flap 54. The flap 54 is then sealed over onto itself, as the flap outline edge 68 is wrapped over by the flap outline edge 70, where the pressure sensitive adhesive adheres the outline edges together. It should be noted that, FIG. 5 is greatly exaggerated in proportion for clarity of explanation, and the relative thickness of cardstock, adhesive, and plastic film are not to scale.

Permanent adhesive may be preferable in some applications, while removable adhesive is preferable in others. In this regard, the nature of an adhesive, whether permanent or removable, is often specified in terms of its "peel force", which is the force required to peel one inch sample strip at right angles from a stainless surface to which it has been adhered. Standard and procedures for measuring peel forces have been established by the Pressure Sensitive Tape Council. The designation "permanent adhesive" is normally applied to an adhesive having a peel force on the order of 3 pounds or more, while adhesives having a peel force of less than about 2 pounds are normally referred to as "removable adhesives".

Material From Which the Embodiment is Constructed

With respect to materials, the backing sheet preferably has a silicone release coating on one side thereof that facilitates removal of the lamination layer from the cardstock sheet. Alternatively, fluorinated or amine-based release coatings may be used, or any other desirable coating. The release-coating layer preferably has a negligible thickness in the order of a few ten-thousandths of an inch. The cardstock layer preferably consists of paper having a thickness of approximately 6.0 mil. It is noted that the sheets shown in the drawings are thicker than their actual dimensions, the relative thickness are not to scale, and the sheets would usually be formed of fairly heavy paper or light cardboard stock.

The cardstock layer may be made from 100 lb velum card stock, which is available from a wide variety of paper manufacturers and vendors, such as the Simpson Corporation. The backing should have a thickness of between 4 and 10 mils. The backing may have a light release coating, such as silicone, to prevent firm adherence of the lamination to the cardstock layer. The release coating should be extremely thin, in the range of between approximately 0.1 and 0.5 mils.

The microperforations consist of cuts that vary in size from 0.0095 to 0.0105 inches and which are separated by ties that vary in size from 0.0045 to 0.0055 inches. Thus, there are between 63 and 69 perforations per inch, with about 66 perforations being an average between the two extremes. More generally, the term "microperforations" indicates that there are more than about 35–40 perforations per inch.

The lamination layer is releasably attached to the cardstock layer by a stable, pressure-sensitive adhesive of a type, which will not flow at a temperature of a few hundred degrees Fahrenheit. However, it is preferred that the pressure sensitive adhesive will remain stable when subjected to temperatures in the range of up to about 300 to about 400 degrees Fahrenheit to facilitate printing on the cards through laser or other high temperature printing equipment. The pressure-sensitive adhesive should be of the type that does not easily degrade when exposed to ultra-violet light. That is, exposure to ultra violet light during normal use of the card should not turn the adhesive yellow or cause the adhesive to lose its tackiness. One such adhesive is described in U.S. Pat. No. 5,262,216. A suitable adhesive is the P60 hot melt adhesive, which is available from the Avery Dennison Corporation. The adhesive should be applied to the laminated sheet 50 in a coat that is between 0.25 and 2.0 mils thick.

The laminated sheet 50 may be made from mylar or any other suitable materials. The laminated sheet 50 may have a coating that is receptive to toners and inks so that the finished assembly can have printing on the surface of the laminated sheet as well as, on the surface of the cardstock layer. Printing on the surface of the lamination would most commonly be accomplished by an offset printing process, although it would be possible to print onto the laminated sheet with a color laser jet, laser, ink jet, bubble jet, thermal transfer printers. Photocopiers may also be used. One could also simply write on the sheet by hand.

Suitable coated and uncoated mylar films are available from DuPont and the Dunmore Corporation. The film should be between 1 and 5 mils thick.

It should be noted that in selecting the above-mentioned materials, the overall thickness of the assembly should not exceed 15 mils. It has been observed that present day laser printers tend not to work well with assemblies having thickness grater than 15 mils. However, if future models of laser printers are developed to be capable of accepting assemblies having a thickness grater than 15 mils, then the maximum overall assembly thickness may be increased. For example, if future printers can reliably handle assembly having 30 mils thickness, then cardstock layer thickness may vary accordingly between 4 to 30 mils.

Additionally, the lamination and backing layer materials should be substantially flat so that the overall assembly has substantially constant thickness throughout its entire width and length, thereby reducing the likelihood that the assembly will jam in the complex paper path of a modern printer. The cardstock and lamination layers should also be free from apertures, tractor-feed holes, depressions and the like, other than the die cuts and perforations, and other very minor discontinuities.

It should be understood that the term "laser printer" may refer not only to laser printers, as such, but also to ink jet printers, photocopiers, and any other printer which will jam when a sheet having a non-constant thickness is input into the printer. The present invention is further intended to be used in conjunction with types of printers not yet developed, or not presently in widespread use. The word "cut" refers not only to die cutting, but also to any other type of cutting, as well as to perforations. The term "microperforations" is intended to encompass all constructions in which the edges of the cardstock sheet are smooth and substantially free of coarse irregularities following separation.

Exemplary dimensions of one embodiment are as follows. A full assembly may be 8½ inches wide by 11 inches long, with a thickness of between approximately 5.25 mils to 15 mils. Various other dimensions and card shapes are, of course, also possible. For instance, as new printers are developed that can accommodate very narrow sheets, the present assemblies may be made correspondingly narrower. Similarly, future printers may accommodate sheets that are more than 8½ inches wide, and the present assemblies may be made wider than 8½ inches.

Figure 12:
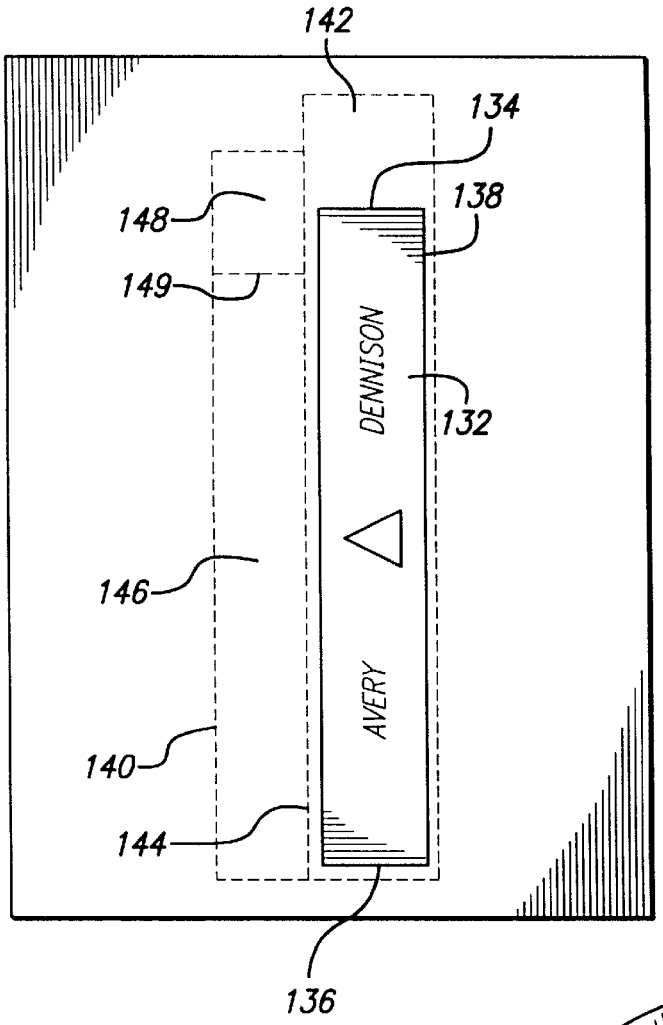
FIG. 12 is a top view of an assembly exemplary that may be used to make napkin ring.
Figure 13:
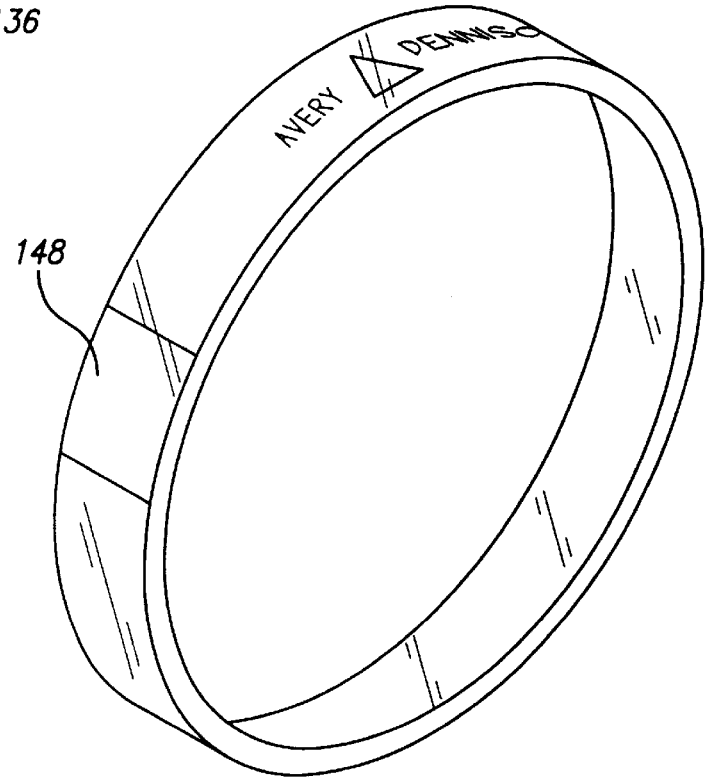
FIG. 13 is a perspective view of the napkin ring assembly shown in FIG. 12 after it has been laminated.

As shown by way of example in FIGS. 12–13, an assembly in accordance with another embodiment of the present invention may be used to create printed laminated napkin ring. The cardstock sheet is preferably die cut into a long rectangular outline 138, forming a long rectangular cardstock strip 132, with the opposite ends 134 and 136.

The lamination sheet also has a die cut outline configured to entirely cover the top and bottom side of the cardstock strip 132. The lamination sheet has a peripheral die cut outline 140 that is slightly greater than twice the size of the strip 132, with additional strip area 142. A die cut 149 runs from the peripheral outline 146 to the center line 144. The die cut 149 divides the flaps 146 and 148.

Once the printing is done on the exemplary assembly, the user pushes the cardstock area 132 through the assembly. Concurrently, the flaps 146 and 148, along with laminate area 142 are peeled from assembly. The user then folds the flap 146 over and bond the flap 146 onto the cardstock area 132. Thereafter, facing the printed side outward, user bends the assembly by placing the opposite end 136 over the laminated area 142. Next, flap 148 is folded over to bond the opposite ends 136 and 134 together, forming this exemplary napkin ring 150 shown in FIG. 13.

As illustrated above, the creation of this laminated napkin ring is relatively easy. The laminated napkin ring is reusable, easy to clean, long lasting, and may be decorated and used in variety of ways. For example, a napkin ring may be placed next to a diner with the diner's name printed on the napkin ring, alternatively an advertisement may be printed on the napkin ring. The cylindrical ring may also be used to hold hot or cold drinking containers. An advantage here is that the combination of laminated plastic and cardstock provides insulation against hot or cold drinking surfaces. Additionally, the laminated plastic sheet protects the cup holder against moisture that forms along the cold cup surfaces due to condensation. Thus, the cup holder may be reused over and over again. At the same time, drinkers may personalize their cups by printing their favorite cartoon characters, sports team logos, or photos of loved ones on the exemplary laminated cylindrical ring 150.

Figure 14:
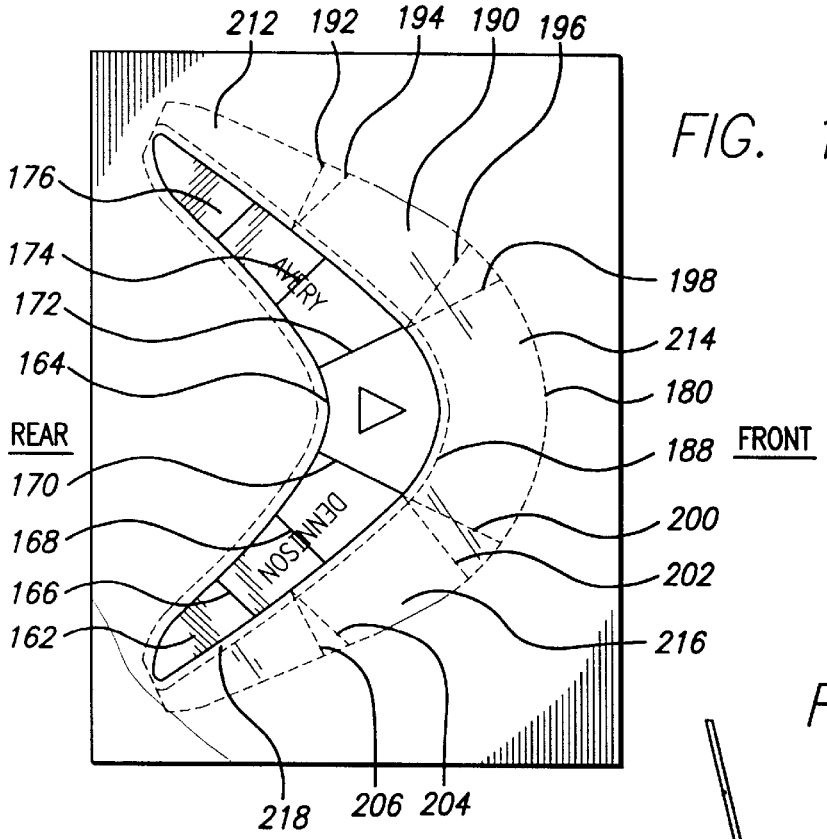
FIG. 14 is a top view of the assembly for making a throwing toy in a shape of a boomerang.
Figure 15:
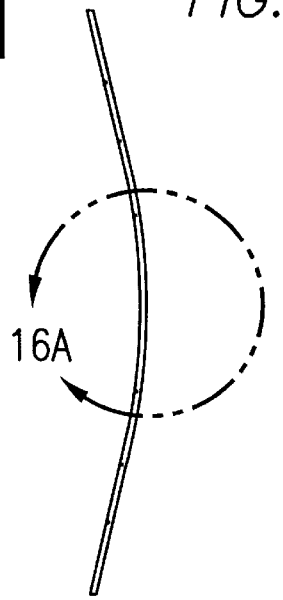
FIG. 15 is a front view of a boomerang shaped toy formed from the assembly shown in FIG. 14 that has been curved along the notches.
Figure 16A:
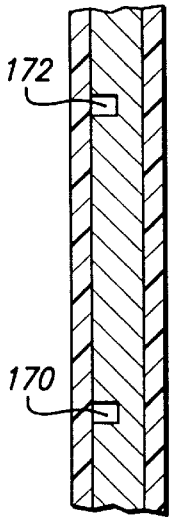
FIG. 16A is an exploded view of the boomerang taken along 16A in FIG. 15.

As shown by way of example in FIGS. 14–16A, another exemplary embodiment of the present invention may be used to create printed laminated boomerang-shaped toy 161. As shown in FIG. 14, the cardstock sheet has a die cut outline in a shape of boomerang 164, forming a cardstock boomerang area 162. The cardstock boomerang 162 may have a plurality of notches 166, 168, 170, 172, 174, and 176. As best shown in FIG. 16A, the notches 170 and 172. The notches enable the boomerang to take on the curved shape shown in FIG. 15.

The laminated sheet has multiple die cuts, configured to allow the plastic film to entirely cover the cardstock boomerang area 162. The plastic film has a die cut 180 with peripheral outline that extends substantially outside of the front edge of the boomerang outline 164. Additionally, the plastic film may have perforations 188 that runs adjacent and extend slightly outside of the front edge 164. If the perforations 188 is used, they will allow the plastic film to easily fold over and bond to the boomerang cardstock area 162.

In this embodiment, the plastic film area between die cut outline 180 and the front edge of the boomerang outline 164 has plurality of paired die cuts: 192 paired with 194, 196 paired with 198, 200 paired with 202, and 204 paired with 206. These paired die cuts define a plurality of flaps 212, 190, 214, 216, and 218. For example, flap 214 is defined by die cuts 198, 200, and 180. The flaps are used to laminate the boomerang cardstock area 162, however, the plastic film areas between plurality of the paired die cuts are not used. This allows the plurality of flaps to cover the boomerang cardstock area 162 juxtaposed to one another, without crimping because of excess plastic film areas. It should be noted that number of flaps used to cover the boomerang cardstock area may vary, depending on the quality of contour lamination around the edges of the boomerang. Consequently, number of paired die cuts used will also vary equally. On the back edge of the boomerang, the plastic film has die cut 186 with peripheral outline that extends slightly outside of the back edge of the boomerang outline 164.

With respect to use, the user may create a printed laminated boomerang by feeding the assembly through a printer or copier. Once the printing is done, the user pushes the boomerang cardstock area 162 and the plurality of flaps through the assembly. Afterwards, the user folds the plurality of flaps over and bonds the flaps onto the boomerang cardstock area 162. Again, flaps lie juxtaposed to each other, forming a continuous lamination that entirely covers the boomerang cardstock area 162. The excess plastic area between the paired die cuts may be discarded. Next, the boomerang cardstock area is preferably sealed by bonding the front outer edge of plastic lamination outline 180 to back outer edge of the plastic lamination outline 186.

Figure 16:
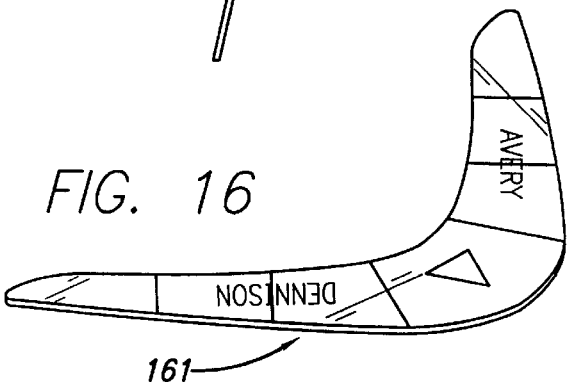
FIG. 16 is a perspective view of a boomerang shaped toy form from the assembly in FIG. 14 that has been laminated.

The printed laminated boomerang may be either flat in its final configuration, as shown by way of example in FIG. 16, or may have three-dimensional shape, as shown by way of example in FIG. 15. For the three dimensional configuration, the boomerang cardstock area 162 may be curved along the notches 166, 168, 170, 172, 174, and 176.

Figure 11:
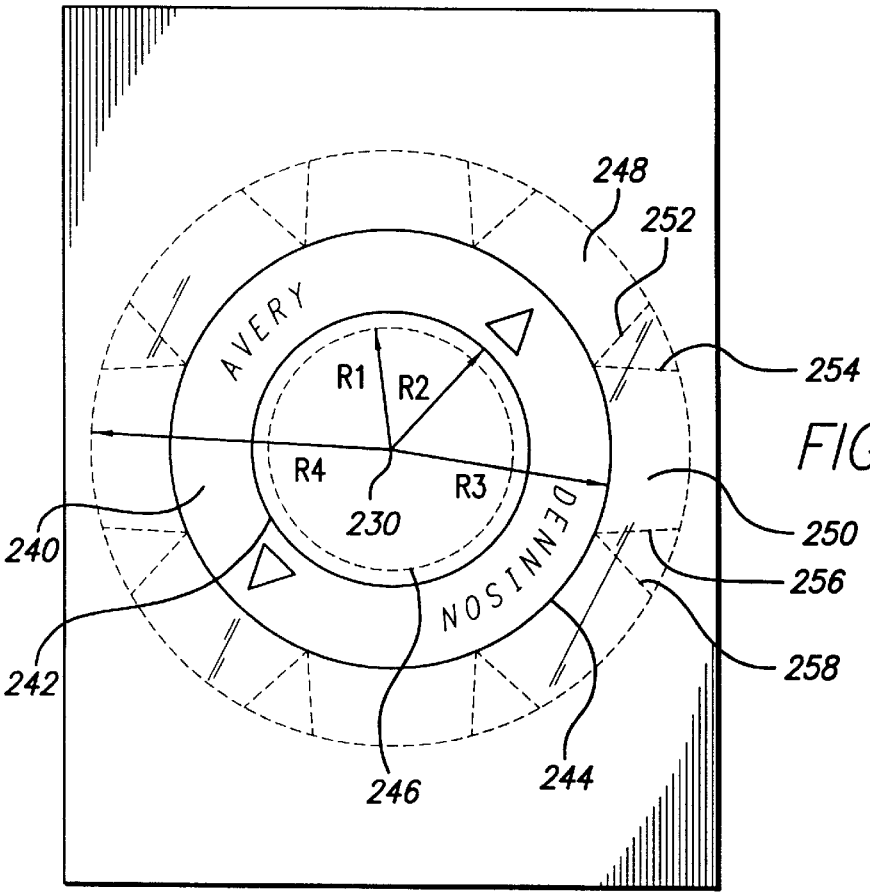
FIG. 11 is a top view of another exemplary assembly that may be used to make a throwing toy.

As shown by way of example in FIG. 11, another exemplary embodiment of the present invention may used to create a printed laminated throwing disk. The throwing disk cardstock area 240 is defined by an inner circular die cut 242 and an outer circular die cut 244. The inner circular die cut 242 has radius R2 from center 230. The outer circular die cut 244 has radius R3 from center 230.

The laminated plastic film in this embodiments has two circular die cuts 246 and 248. The circular die cut 246 has the radius R1 from the center 230 that is less than the radius R2, while the circular die cut 248 has a radius R4 from center 230 that extends substantially outside of the radius R3, such that plastic film area between 248 and 244 will sufficiently cover the throwing toy cardstock area. The plastic film also has plurality of paired die cuts (such as, 252 with 254 and 256 with 258) that run from the circular die cut 248 to the outer edge of circular die cut 244. The paired die cuts define a plurality of flaps. For example, flap 250 is defined by die cut 254 and die cut 256. The flaps are used to laminate the throwing disk area 240, while the plastic film areas between plurality of the paired die cuts are not used. This allows the plurality of flaps to cover the area 242 juxtaposed to each other, without crimping because of excess plastic film areas. It should be noted that number of flaps used to cover the throwing disk area may vary, depending on the quality of lamination around the contour edges of the disk area. Consequently, number of pared die cuts used will also vary equally.

A printed throwing disk may be created by feeding the assembly through a printer or copier. Once the printing is done, the user pushes the throwing disk cardstock area 240 and the plastic film areas through the assembly. Afterwards, the user may fold the plurality of flaps over and bond the flaps onto the area 240. Again, flaps lie juxtaposed to each other, forming a continuous lamination that entirely covers the area 240. The excess plastic area between the paired die cuts may be discarded. Next, the boomerang cardstock area may be sealed by bonding the circular outer edge 248 with inner circular edge 246.

The present assembly can be configured to create other goods in addition to the exemplary throwing toy, cup holder, and boomerang, that can be configured in either a two-dimensional or three dimensional format. Consequently, the assembly is not limited to elementary configurations that are rectangular or simple symmetrical configurations that fold over about center line. Instead, this invention allows the user to create assorted goods that are free form shape, which may be curved and/or non-symmetrical. To laminate the free form shape cardstock, at least two flaps are configured by a die cut in the plastic film, which is folded over along the contour edges of the cardstock. Additionally, user may place photos or cut outs on the cardstock, then laminate for protection.

It is further noted that although fairly heavy paper or cardstock is preferred, the term "cardstock" as used herein could also refer to any printable and flexible layer that may be reliably used with home or office printers. An example includes normal sheets of paper, plastic layer, or Styrofoam layer that may be printable and flexible enough to be reliably used with a home or office printers.

U.S. Pat. No. 5,662,976, assigned to the assignee of this invention was cited above, and the entire specification of that patent is hereby incorporated into this specification by reference particularly with regard to materials, and adhesives and the like which may be employed in the implementation of this invention.

In conclusion, it is to be understood that the foregoing detailed description and the accompanying drawings relate to the presently preferred illustrative embodiment of the invention. However, various changes may be made without departing from the spirit and scope of the invention. Thus, example used to illustrate the spirit and scope of the invention are not of limitation. Additionally, the proportional dimensions of the drawings are for illustrative purposes only. The adhesives in the cross-sectional views, as well as other aspects of the assembly are drawn out of proportion for clarity of explanation. Furthermore, several goods may be configured from a single assembly, thereby optimally utilizing the space on the assembly. For example, signal assembly may have die cut outlines for a boomerang and a napkin ring or several die cut napkin ring outlines.

What is claimed is:

1. A multilayer sheet assembly for forming printed laminated three-dimensional configured articles for throwing toys, by a printer or copier, comprising:

a cardstock sheet;

a flexible plastic sheet generally coextensive with said cardstock sheet;

a layer of pressure sensitive adhesive between said cardstock sheet and said plastic sheet;

said assembly being sufficiently flexible to reliably pass through a printer or copier, and being 15 mils or less in thickness;

said cardstock sheet having a die cut outline around the configuration of said throwing toys shaped structure to be formed, having a plurality of notches or lines of weakness extending transversely across said die cut outline, said notches or lines of weakness allowing said assembly to take a curved shape;

said flexible plastic sheet and said pressure sensitive adhesive having a die cut in a peripheral outline substantially outside of and encompassing the die cut outline on said cardstock; and said flexible plastic sheet having additional die cuts from said periphery up to the edge of the cardstock outline;

wherein said assembly has a toy die cut outline of a throwing toy in said card stock sheet, said plastic film having die cut areas that are greater than said toy die cut area, said plastic film having flaps which fold over said toy die cut area to retain said toy die cut area in a three dimensional configuration.

2. An assembly as defined in claim 1, wherein said assembly is a throwing toy which has a plurality of wings, said wings being aligned symmetrically around a center.

3. An assembly as defined in claim 1, wherein said cardstock sheet has a die cut outline of a boomerang.

4. An assembly as defined in claim 1, wherein said pressure sensitive adhesive is a permanent adhesive.

5. An assembly as defined in claim 1, wherein said lamination sheet includes a perforation or line of weakness running adjacent and extending outside of the cardstock edge, thereby assisting the user in folding the plastic lamination sheet about the perforation.

6. A multilayer assembly for creating printed three-dimensional configured articles, comprising:

a printable sheet;

a flexible plastic film generally coextensive with said printing sheet;

a layer of pressure sensitive adhesive between said printable layer and said plastic film;

said assembly being sufficiently flexible to reliably pass through a printer or copier;

said printable sheet having a die cut outline defining a free form article;

said flexible plastic film and said pressure sensitive adhesive layer having a die cut in a peripheral outline substantially outside of and encompassing said die cut outline on said printable sheet; and wherein said plastic film has flaps folded over said printed sheet outline, to retain said printed sheet outline in a three dimensional configuration.

7. An assembly as defined in claim 6, wherein said printable sheet has a die cut outline of a long rectangle strip, said strip having opposite ends, said plastic film having a die cut outline that is greater than twice the area of said long rectangular strip, said plastic film having a large flap and a small flap, said large flap folded over and covering said strip, said opposite ends coupled together to form a cylindrical ring, said smaller flap folded over and covering said cylindrical ring.

8. An assembly as defined in claim 6, wherein said article is a throwing toy which has a plurality of wings, and said plurality of wings being aligned symmetrically around a center.

9. An assembly as defined in claim 6, wherein said article has a die cut outline configuration of a boomerang.

10. An assembly as defined in claim 6, wherein said pressure sensitive adhesive is a permanent adhesive.

11. An assembly as defined in claim 6, wherein said plastic film comprise a perforation running adjacent and extending outside of said article edge, thereby assisting the user in folding the lamination film about the perforation.

12. An assembly as defined in claim 6, wherein said assembly is 15 mils or less in thickness.

13. An assembly as defined in claim 6, wherein said flexible plastic film has additional die cuts from said periphery up to the edge of said printable sheet outline.

14. A multilayer sheet assembly for forming printed laminated free form article, comprising:

a cardstock sheet;

a flexible plastic sheet with said cardstock sheet;

a layer of intermediate pressure sensitive adhesive adhering said cardstock sheet to said plastic sheet;

said assembly being sufficiently flexible to reliably pass through a printer or copier;

said cardstock sheet having a die cut outline defining the configuration of a free form article; and said flexible plastic sheet having a die cut in a peripheral outline that extend substantially outside of and encompassing said die cut outline of said article;

wherein said free form article has a die cut outline of a strip, said strip having opposite ends, said plastic film having a die cut outline that is greater than the area of said strip, said plastic film having a large flap and a small flap, said large flap folded over and covering said strip, said opposite ends coupled together to form a cylindrical ring, said smaller flap formed to engage said strip and retain the strip in the cylindrical ring shape.

15. An assembly as defined in claim 14, wherein said plastic laminate has a die cut configuration that is non-symmetrical to said cardstock die cut configuration.

16. An assembly as defined in claim 14, wherein said plastic laminate has a plurality of die cuts, said die cuts defining at least two flaps.

17. An assembly as defined in claim 14, wherein said pressure sensitive adhesive is a permanent adhesive.

18. An assembly as defined in claim 14, wherein said lamination film includes a perforation running adjacent and extending outside of the cardstock edge, thereby assisting the user in folding the lamination film about the perforation.

19. An assembly as defined in claim 14, wherein said assembly is 15 mils or less in thickness.

20. A multilayer assembly for forming a laminated identification ring band comprising:

a printable layer;

a flexible transparent film having an intermediate layer of pressure-sensitive adhesive on one side, the layer of pressure-sensitive adhesive releasably adhering the film to the printable layer;

at least one set of die cut elements for forming the ring band included in the assembly, the set comprising:

an elongated die cut area in the printable layer, wherein the area defines a printing area;

a die cut area in the transparent film having an outline that peripherally extends at least twice the extend of the elongated die cut area of the printable layer; and the die cut outline having at least one tabular extension at least one end of the elongated end of the outline, wherein the at least one tabular extension is coupled to the opposing end of said die cut section of the band sheet to form at least one laminated identification band;

wherein the die cut area of the printable layer is adapted to be pushed through the assembly carrying the die cut printing area and the die cut outline of the film, the film is adapted to be folded over and bonded to the printing area, and the assembly is adapted to be curled over, exposing the printing area and coupling the tabular extension to the other end, to form the laminated identification ring band.

21. A multilayer assembly according to claim 20 wherein said die cut outline of the film has at least one line of weakness running adjacent and extending outside of the printing area of the printable layer.

22. A multilayer assembly according to claim 20 wherein at least one tabular extension has two tabular extensions, the first and the second tabular extension on opposite ends of the elongated outline of the film.

23. A multilayer assembly according to claim 20 wherein the assembly has a substantially constant thickness.

24. A multilayer assembly according to claim 23 wherein the assembly is 15 mils or less in thickness.

25. A multilayer assembly according to claim 24 wherein the printer or the copier prints identification on the printing area.

26. A flexible ring assembly comprising a paper strip having a printed face and a non-printed face, wherein the non-printed face is on the opposite side of the printed face, the non-printed face being adhered to a substantially coextensive portion of an adhesive-coated film, the printed face of the paper strip being adhered to and covered by a folded over portion of the adhesive-coated film and wherein at least the portion of said film adhered to the non-printed face or said folded over portion has an integral tab that extends longitudinally from the film adhered to the paper strip, wherein said integral tab having an adhesive coating on one face thereof to attach to the other end of said film to form a flexible ring assembly.

27. A flexible ring assembly comprising:

a generally rectangular and elongated paper strip having a printed face and a non-printed face on the opposite side thereof, the non-printed face being adhered to a substantially coextensive portion of an adhesive-coated film, the printed face of the paper strip being adhered to and covered by a folded over portion of the adhesive-coated film and wherein at least the portion of said film adhered to the non-printed face or said folded over portion has an integral tab that extends longitudinally from the film adhered to the paper strip; and at least one of the portion of the film adhered to the non-printed face of the paper strip or the folded over portion adhered to the printed face having an integral tab extending longitudinally at one end of the paper strip, said integral tab having pressure-sensitive adhesive coating on one face thereof to attach to the other end of said film to form a flexible ring assembly.

28. A multilayer sheet assembly for forming printed laminated three-dimensional configured articles with a printer or copier, in which said multilayer sheet assembly has:

a cardstock sheet;

a flexible plastic sheet generally coextensive with said cardstock sheet;

a layer of pressure sensitive adhesive between said cardstock sheet and said plastic sheet;

said assembly being sufficiently flexible to reliably pass through a printer or copier, and being 15 mils or less in thickness;

said cardstock sheet having a die cut outline defining a configuration of said shaped structure to be formed, having a plurality of notches or lines of weakness extending transversely across said die cut outline, said notches or lines of weakness allowing said assembly to take a curved shape;

said flexible plastic sheet and said pressure sensitive adhesive having a die cut in a peripheral outline substantially outside of and encompassing the die cut outline on said cardstock;

said flexible plastic sheet having additional die cuts from said periphery up to the edge of the cardstock outline; and said plastic sheet having flaps which fold over said die cut outline to retain said die cut outline in a three dimensional configuration.

* * * * *